US009205432B2

(12) United States Patent
Chang et al.

(10) Patent No.: US 9,205,432 B2
(45) Date of Patent: Dec. 8, 2015

(54) APPARATUS FOR SELF-EXTRACTING CELLS USING MAGNETIC FIELD AND METHOD FOR SELF-EXTRACTING CELLS USING THE SAME

(75) Inventors: Sung Hwan Chang, Daejeon (KR); Yeong-Eun Yoo, Daejeon (KR); Jung Yup Kim, Daejeon (KR); Seung Min Hyun, Daejeon (KR); Kyung-Hyun Whang, Daejeon (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 676 days.

(21) Appl. No.: 13/546,187

(22) Filed: Jul. 11, 2012

(65) Prior Publication Data

US 2013/0284676 A1 Oct. 31, 2013

(30) Foreign Application Priority Data

Apr. 30, 2012 (KR) ..... 10-2012-0045751

(51) Int. Cl.
*B03C 1/28* (2006.01)

(52) U.S. Cl.
CPC ..... *B03C 1/288* (2013.01); *B03C 2201/26* (2013.01)

(58) Field of Classification Search
CPC ..... B03C 1/288; B03C 2201/26
See application file for complete search history.

(56) References Cited

U.S. PATENT DOCUMENTS

| | | | | |
|---|---|---|---|---|
| 8,951,782 | B2 * | 2/2015 | Chang et al. | 435/288.5 |
| 2004/0018611 | A1 * | 1/2004 | Ward et al. | 435/287.2 |
| 2008/0302732 | A1 * | 12/2008 | Soh et al. | 210/695 |

FOREIGN PATENT DOCUMENTS

| | | |
|---|---|---|
| JP | 05-034337 | 2/1993 |
| JP | 07-506257 | 7/1995 |
| JP | 2004-042012 | 2/2004 |
| JP | 2005-007352 | 1/2005 |
| JP | 2009-109232 | 5/2009 |
| JP | 2011-510656 | 4/2011 |
| KR | 10-0624460 | 9/2006 |
| KR | 10-2008-0002096 | 1/2008 |
| KR | 10-0872497 | 12/2008 |
| KR | 10-2011-0041126 | 4/2011 |
| KR | 10-2012-0031218 | 3/2012 |
| WO | 2010-141921 | 12/2010 |
| WO | 2010-144745 | 12/2010 |

* cited by examiner

*Primary Examiner* — David A Reifsnyder
(74) *Attorney, Agent, or Firm* — Lex IP Meister, PLLC

(57) ABSTRACT

Disclosed is an apparatus for self-extracting a cell using a magnetic field. The apparatus for self-extracting the cell using the magnetic field according to the present invention includes a flow path casing including an upper substrate and a lower substrate having a magnetic property combined with each other, and a fluid path formed to fluidize a cell solution therein; a separation portion disposed on the fluid path and provided with a separation channel selectively passing only an effective cell that is a separation target in the cell included in the cell solution therethrough; and a magnetic field control portion forming the magnetic field in the flow path portion to separate the cell blocking the separation channel from the separation channel.

5 Claims, 8 Drawing Sheets

APPARATUS FOR SELF-EXTRACTING CELLS USING MAGNETIC FIELD AND METHOD FOR SELF-EXTRACTING CELLS USING THE SAME

CROSS-REFERENCE TO RELATED APPLICATION

This application claims priority to and the benefit of Korean Patent Application No. 10-2012-0045751 filed in the Korean Intellectual Property Office on Apr. 30, 2012, the entire contents of which are incorporated herein by reference.

BACKGROUND OF THE INVENTION (a) Field of the Invention

The present invention relates to an apparatus for self-extracting a cell using a magnetic field, and a method using the same, and more particularly, to an apparatus for self-extracting a cell using a magnetic field to easily extract an effective cell from a cell solution, and a method using the same.

(b) Description of the Related Art

Generally, since a biochemical sample exists while two kinds or more materials are mixed with each other, a separation technology for analyzing only a desired component or purifying only a predetermined component in a mixture is very important during a pretreatment process of the sample. Particularly, a preparation process of the sample such as purification and separation is an essential technology to be performed prior to a subsequent analysis process even in a lab-on-a-chip that is a concept of treating a small amount of sample at a high speed and high efficiency by integrating a fine flow path, a mixer, a pump, a valve and the like on a single chip.

Further, cell-based diagnostics that are important in a biological or medical analysis are formed of blood analyses, cell studies, microorganism analyses and tissue transplant. Recently, unification and integration of processes of the cell-based diagnostics into a microfluidic device form have been studied in accordance with development of cell studies, cell analyses, and protein and DNA analysis technologies.

However, in the case of a known cell separation method and apparatus using a fine fluid channel and the like, cell separation performance is unsatisfactory, and accordingly, it is difficult to substantially use the method and apparatus.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an apparatus for self-extracting a cell using a magnetic field capable of selectively separating the cell using a separation channel and actively preventing an effective cell from blocking the separation channel by generating the magnetic field, and a method using the same.

An exemplary embodiment of the present invention provides an apparatus for self-extracting a cell using a magnetic field to extract an effective cell that is a separation target from a cell solution, including: a flow path casing including an upper substrate and a lower substrate having a magnetic property combined with each other, and a fluid path formed to fluidize the cell solution therein; a separation portion disposed on the fluid path and provided with a separation channel selectively blocking the effective cell that is an extraction target in the cell included in the cell solution from passing therethrough; and a magnetic field control portion forming the magnetic field in the flow path portion to separate the effective cell blocking the separation channel from the separation channel.

The separation channel may be constituted so that a width thereof becomes gradually narrow in a fluid direction of the cell solution.

The separation portion may include a plurality of fine structures spaced apart from each other so that the width thereof becomes gradually wide in the fluid direction of the cell solution to form the separation channel.

The plurality of fine structures may be constituted so that a gradient of the magnetic field generated between the magnetic field control portion and the lower substrate is increased.

An addition port for adding the cell solution and a discharge port for discharging a non-effective cell passing through the separation portion to the outside may be formed at both ends of the fluid path.

The lower substrate may be formed by curing a mixed solution of a polymer resin and a ferromagnetic particle.

The magnetic field control portion may operate the magnetic field in the fluid path to perform controlling in the case where the separation channel is blocked by the effective cell.

The magnetic field control portion may be constituted by an electromagnet to control an applied current, thereby controlling the intensity of the magnetic field.

Another exemplary embodiment of the present invention provides a method for extracting a cell using a magnetic field, including: an addition step of adding a cell solution including an effective cell that is an extraction target and a non-effective cell that is a non-extraction target to a fluid path of a flow path casing; an extraction step of passing the cell solution through each of a plurality of separation channels to pass the non-effective cell therethrough and selectively extract the effective cell; and a magnetic field generation step of generating the magnetic field in the fluid path so as not to block the separation channel by the effective cell.

In the magnetic field generation step, the magnetic field may be generated while the addition step is performed to basically prevent the effective cell from blocking the separation channel.

In the magnetic field generation step, the magnetic field may be selectively generated to separate the effective cell blocking the separation channel from the separation channel.

According to the exemplary embodiments of the present invention, there is provided an apparatus for self-extracting a cell using a magnetic field to easily self-extract an effective cell that is a separation target using a separation channel magnetic field.

Further, it is possible to basically prevent the effective cell that is the extraction target from blocking the separation channel by generating the magnetic field.

In addition, it is possible to self-remove the effective cell by selectively generating the magnetic field only in the case where the separation channel is blocked by the effective cell.

DETAILED DESCRIPTION OF THE EMBODIMENTS

Hereinafter, an apparatus for self-extracting a cell using a magnetic field according to an exemplary embodiment of the present invention will be described in detail with reference to the accompanying drawings.

Figure 1:
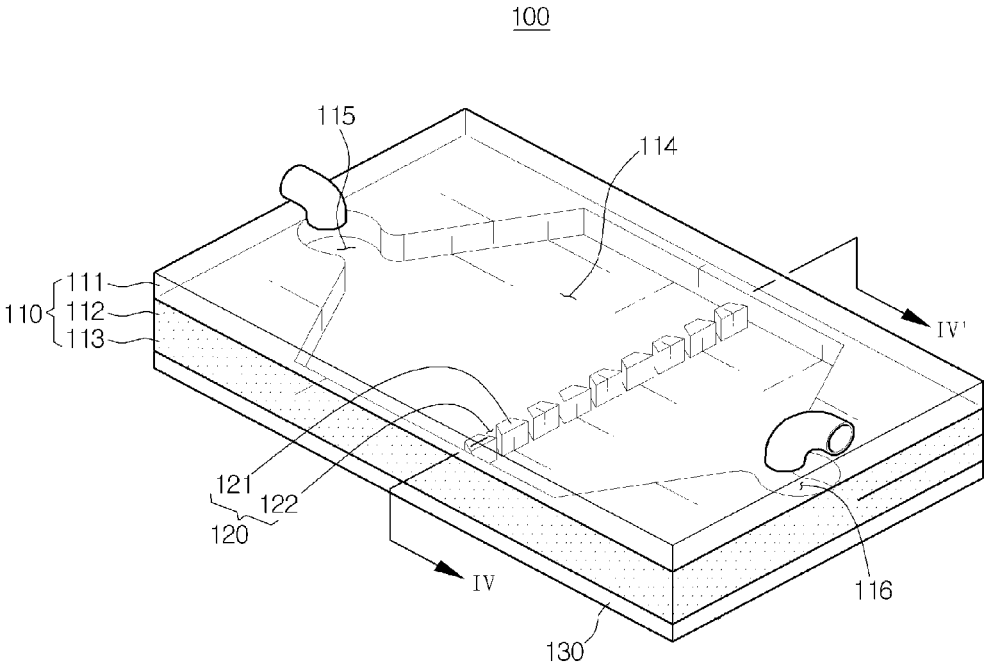
FIG. 1 is a schematic perspective view of an apparatus for self-extracting a cell using a magnetic field according to an exemplary embodiment of the present invention.
Figure 2:
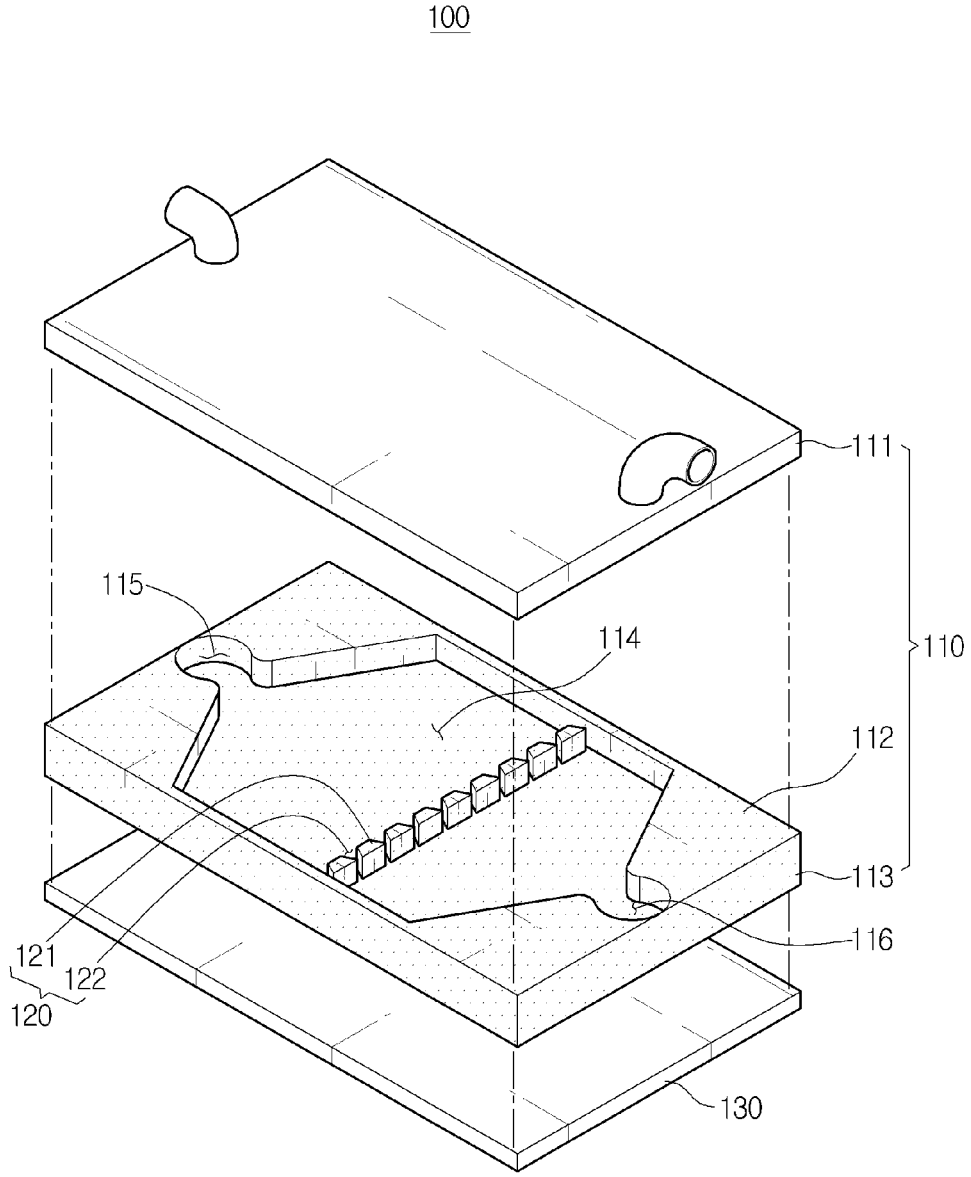
FIG. 2 is a schematic exploded perspective view of the apparatus for self-extracting the cell using the magnetic field of FIG. 1.
Figure 3:
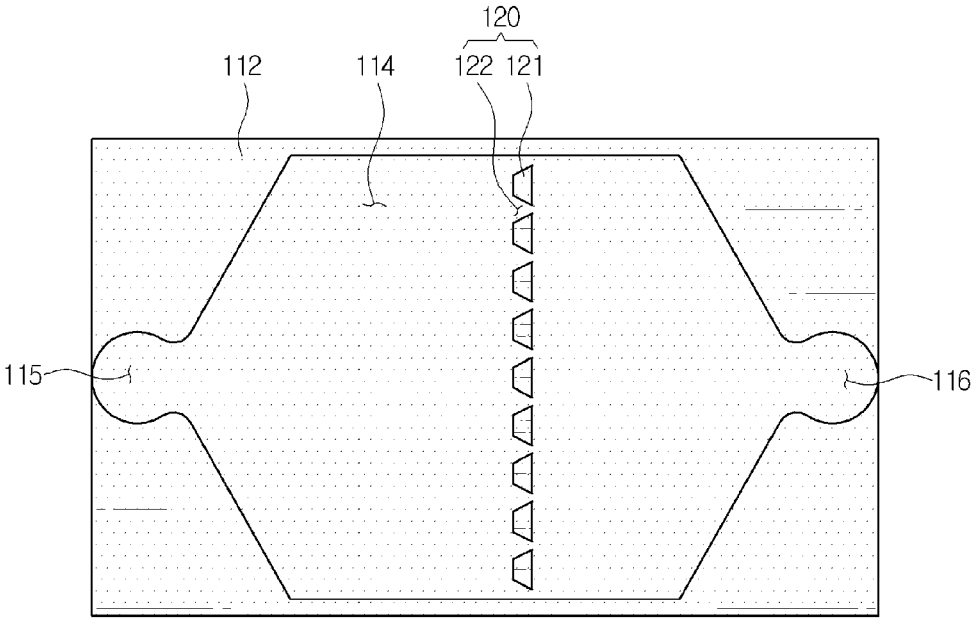
FIG. 3 is a schematic top plan view of the apparatus for self-extracting the cell using the magnetic field of FIG. 1, from which an upper substrate is removed.
Figure 4:
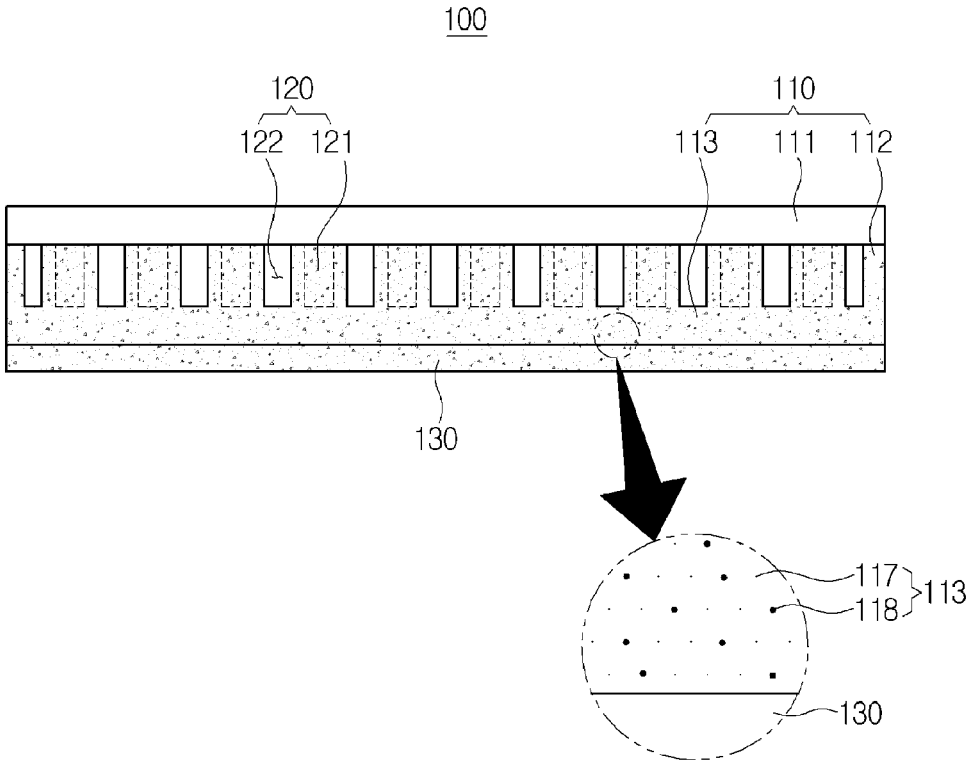
FIG. 4 illustrates a cross-section of the apparatus for self-extracting the cell using the magnetic field of FIG. 1, which is taken along the cut line IV-IV'.

FIG. 1 is a schematic perspective view of an apparatus for self-extracting a cell using a magnetic field according to an exemplary embodiment of the present invention, FIG. 2 is a schematic exploded perspective view of the apparatus for self-extracting the cell using the magnetic field of FIG. 1, FIG. 3 is a schematic top plan view of the apparatus for self-extracting the cell using the magnetic field of FIG. 1, from which an upper substrate is removed, and FIG. 4 illustrates a cross-section of the apparatus for self-extracting the cell using the magnetic field of FIG. 1, which is taken along the cut line IV-IV'.

Referring to FIGS. 1 to 4, an apparatus 100 for self-extracting a cell using a magnetic field according to the exemplary embodiment of the present invention relates to an apparatus for extracting a cell which selectively self-extracts only an effective cell 20 from a cell solution including the effective cell 20 that is an extraction target and a non-effective cell 10 that is a non-extraction target, and includes a flow path casing 110, a separation portion 120 and a magnetic field control portion 130.

A fluid path 114 for fluidizing the cell solution is formed in the flow path casing 110, and the flow path casing 110 includes an upper substrate 111, a side wall 112 and a lower substrate 113.

The upper substrate 111 is combined with the side wall 112 and the lower substrate 113 to be described below so as to form the fluid path 114, and has a flat plate shape. In the present exemplary embodiment, polydimethylsiloxane (PDMS), polytetrafluroethylene (PTFE), polymethyl methacrylate (PMMA), cycloolefin copolymer (COC) and the like may be used as the upper substrate 111, but any general polymer material may be used without limitation.

The side wall 112 is interposed between the upper substrate 111 and the lower substrate 113 to be described below to connect both constituent elements to each other, and forms a space in the flow path casing 110 so as to provide the fluid path 114, an addition port 115 and a discharge port 116 therein.

That is, the side wall 112 constitutes a border between the upper substrate 111 and the lower substrate 113, and forms a space as the fluid path 114 therein. Specifically, the fluid path 114 where a central region has the largest width and the width becomes narrow as going to both ends is formed in the side wall 112. Further, the addition port 115 for adding the cell solution is formed at one end of the fluid path 114, and the discharge port 116 for discharging the non-effective cell 10 passing through the separation portion 120 to the outside is formed at the other end of the fluid path 114.

Meanwhile, the lower substrate 113 to be described below and the side wall 112 may be integrally formed of the same material in a single process, but may be separately manufactured through precision processing to be firmly attached to each other.

The lower substrate 113 is integrally manufactured with the side wall 112 described above and the separation portion 120 to be described below to finish the fluid path 114 at the lower part thereof, and is formed to have the same flat plate shape as the upper substrate 111.

The separation portion 120 is provided on the fluid path 114 in the flow path casing 110 to act as a filter for selectively extracting only the effective cell 20 that is the extraction target from the cell solution and act as a structure for increasing a gradient of the magnetic field generated from the magnetic field control portion 130 to be described below, and is constituted by a plurality of fine structures 121 and a separation channel 122 between the fine structures 121.

The plurality of fine structures 121 are spaced apart from each other in a width direction of the fluid path 114 so as to form the separation channel 122, and each fine structure 121 has a shape where a width becomes gradually wide in a fluid direction (D) of the cell solution.

Accordingly, the separation channel 122 formed in a space between the fine structures 121 where the width becomes gradually wide in the fluid direction (D) of the cell solution has a shape where a width becomes gradually narrow in the fluid direction (D) of the cell solution on the contrary to the shape of the fine structure 121.

Meanwhile, the width of the fine structure 121, the degree of change in width, the height and the like needs to be designed in overall consideration of a fluid speed of the cell solution, a kind of the cell solution, and a kind and a size of the effective cell 20 to be extracted.

Further, the fine structure 121 acts as a structure for increasing a gradient of the magnetic field generated between the magnetic field control portion 130 to be described below and the fine structure and it is necessary to determine a shape in consideration of the gradient of the magnetic field to be generated.

Meanwhile, the side wall 112, the lower substrate 113 and the separation portion 120 that are integrally formed are manufactured by curing a mixing material where ferromagnetic particles 118 are mixed with a liquid type polymer resin 117 so as to have a magnetic property.

Nano or micro particles of nickel (Ni), cobalt (Co), iron (Fe) and the like may be used as the ferromagnetic particles 118 used in the present exemplary embodiment. Further, in the exemplary embodiment, polydimethylsiloxane (PDMS), polytetrafluroethylene (PTFE), polymethyl methacrylate (PMMA), cycloolefin copolymer (COC) and the like may be used as the polymer resin 117, but any general polymer material may be used without limitation.

In addition, a separate non-ferromagnetic additive may be further included in the mixing material to improve characteristics such as strength, electric conductivity and thermal conductivity.

Carbon nanotubes (CNT), carbon fibers, glass fibers or two or more thereof may be mixed and used while being mixed with each other as the non-ferromagnetic additive, and the non-ferromagnetic additive is not limited thereto as long as the non-ferromagnetic additive helps to improve the characteristics of the mixing material after curing.

Therefore, according to the structure of the flow path casing 110 and the separation portion 120 described above, the fluid path where the addition port 115 and the discharge port 116 are formed at both ends is provided in the flow path casing, and since the lower substrate 113, the side wall 112 and the separation portion 120 include the uniformly distributed ferromagnetic particles 118, the magnetic property is ensured.

The magnetic field control portion 130 is operated together with the lower substrate 113 and the ferromagnetic particles 118 in the fine structure 121 to generate the magnetic field in order to basically prevent the effective cell 20 that is the extraction target from blocking the separation channel 122 or selectively be operated only in the case where the effective cell 20 blocks the separation channel to prevent the blocking, and is provided at the lower part of the lower substrate 113.

Further, in the exemplary embodiment, the magnetic field control portion 130 may be provided in an electromagnet form to control the intensity of magnetic property and operation, such that the intensity of total magnetic field may be controlled by controlling a quantity of applied current, but the form of the magnetic field control portion 130 is not limited thereto and the magnetic field control portion 130 may be provided in a permanent magnet form.

An electromagnet may be provided, but a matter such as the permanent magnet which can generate the magnetic field may be used without limitation.

Hereinafter, operation of the apparatus 100 for self-extracting the cell using the magnetic field according to an exemplary embodiment will be described.

Figure 5:
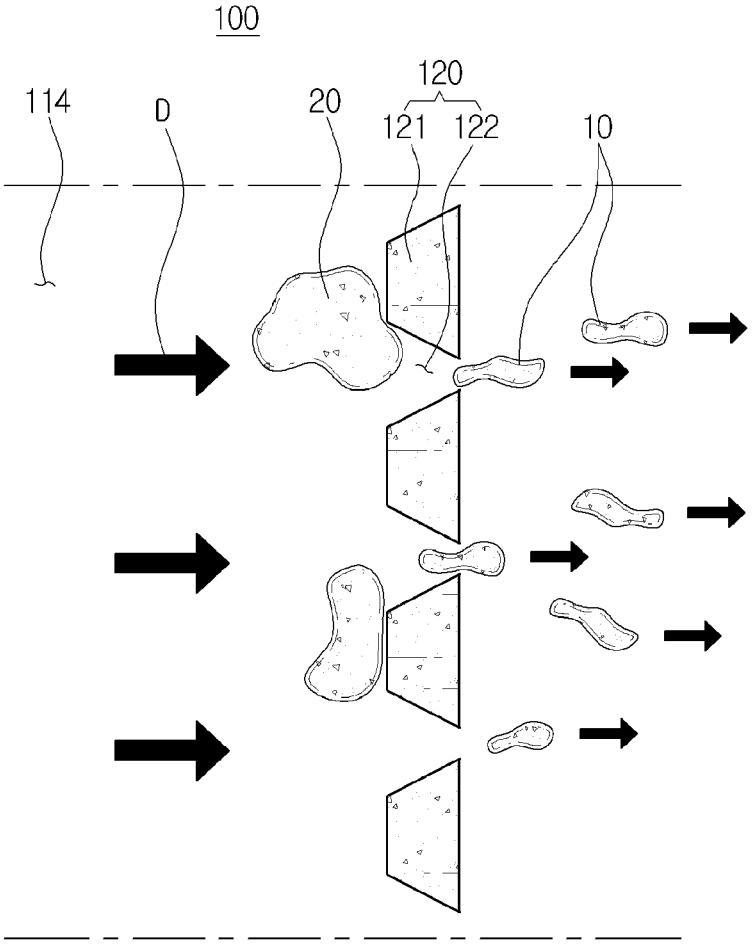
FIGS. 5 and 6 illustrate an operation principle of separating an effective cell by the apparatus for self-extracting the cell using the magnetic field of FIG.
Figure 6:
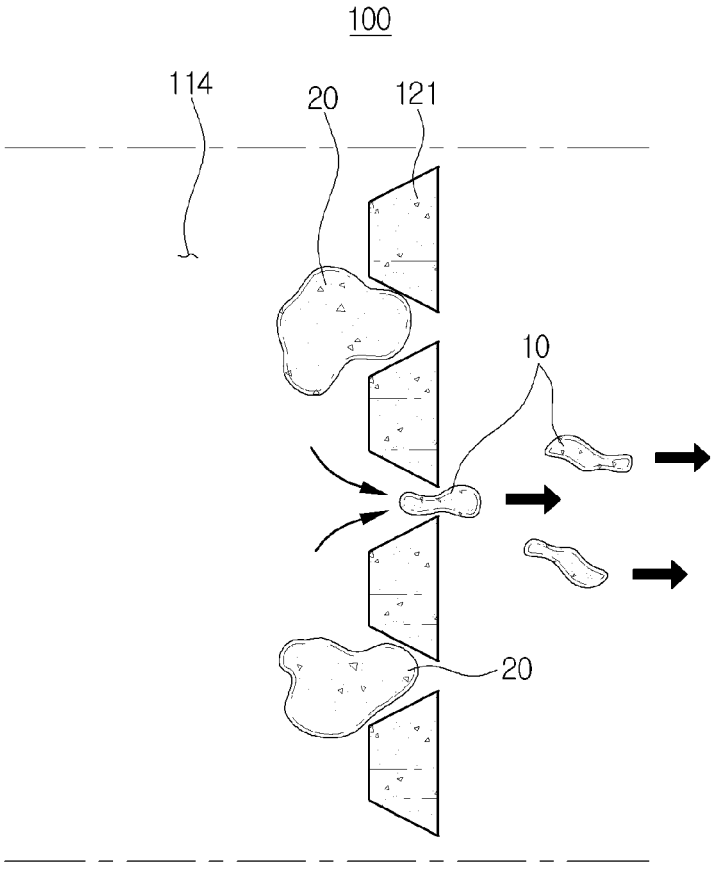

FIGS. 5 and 6 illustrate an operation principle of separating an effective cell by the apparatus for self-extracting the cell using the magnetic field of FIG. 1.

First, the cell solution including the effective cell 20 that is the extraction target and the non-effective cell 10 that is not the extraction target is continuously added through the addition port 115 at the end of the fluid path 114. The cell solution added through the addition port 115 is continuously fluidized along the fluid path 114 and reaches the separation portion 120.

In this case, as shown in FIG. 5, the non-effective cell 10 having a diameter that is smaller than the width of the separation channel 122 passes through the separation channel 122 of the separation portion 120 and is discharged through the discharge port 116 at the end of the fluid path 114 to the outside.

Furthermore, as shown in FIG. 6, the effective cell having a diameter that is larger than the width of the separation channel 122 does not completely pass through the separation channel 122 but is extracted.

Figure 7:
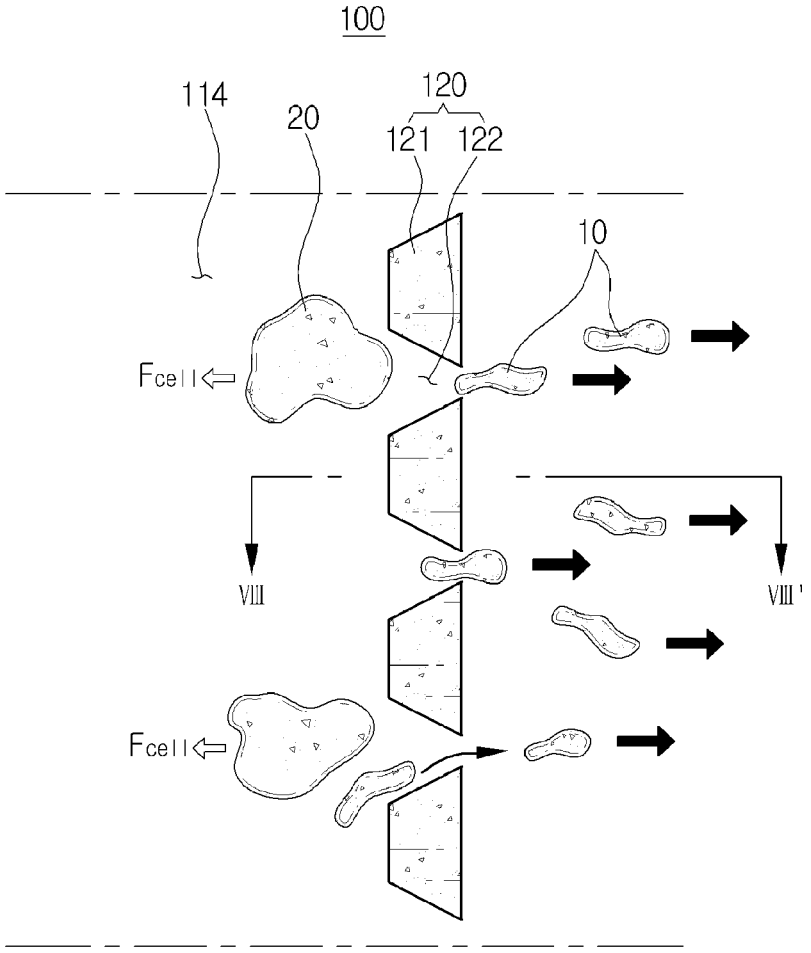
FIG. 7 illustrates a principle of separating the effective cell blocking a separation channel in the apparatus for self-extracting the cell using the magnetic field of FIG. 1.

FIG. 7 illustrates a principle of separating the effective cell blocking a separation channel in the apparatus for self-extracting the cell using the magnetic field of FIG. 1.

Meanwhile, the magnetic field control portion 130 generates the magnetic field between the lower substrate 113 and the fine structure 121 while the cell solution is fluidized as described above, and the generated magnetic field is formed in the fluid path 114.

As shown in FIG. 7, the effective cell 20 may not block the separation channel 122 but be self-extracted by force ($F_{cell}$) applied to the effective cell 20 from the magnetic field generated by the operation of the magnetic field control portion 130.

$$F_{cell} = \frac{1}{2}\frac{\Delta_\chi \cdot V_{cell}}{\mu_0}\nabla|B|^2 \quad \text{(Equation 1)}$$

$$F_{cell} = \frac{1}{2}\frac{\Delta_\chi \cdot V_{cell}}{\mu_0}\nabla|B|^2$$

($F_{cell}$: force applied to the effective cell, $V_{cell}$: volume of the effective cell, $\nabla|B|$: gradient of the magnetic field, $\Delta_\chi$: difference in magnetic susceptibility of the effective cell and the cell solution, and $\mu_0$: magnetic permeability in a vacuum)

That is, turning to the aforementioned self-extracting of the effective cell 20, the force ($F_{cell}$) applied to the effective cell 20 by the magnetic field generated from the magnetic field control portion 130 with the exception of gravity and fluidizing force by the cell solution may be represented by Equation 1.

Figure 8:
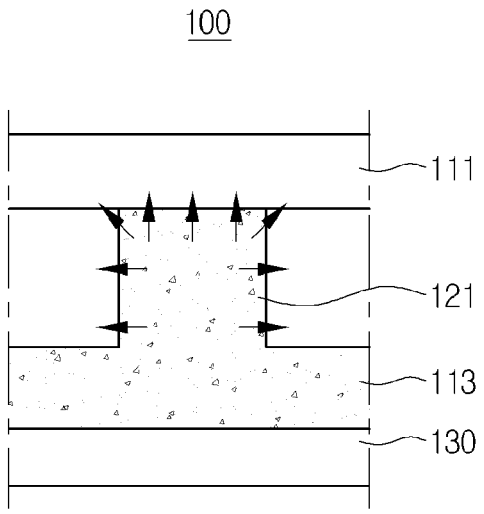
FIG. 8 illustrates a cross-section of the apparatus for self-extracting the cell using the magnetic field of FIG. 7, which is taken along the cut line VIII-VIII'.

FIG. 8 illustrates a cross-section of the apparatus for self-extracting the cell using the magnetic field of FIG. 7, which is taken along the cut line VIII-VIII'.

In this case, as shown in FIG. 8, since the fine structure 121 having a shape protruding from the lower substrate 113 to the upper side functions to increase the gradient ($\nabla|B|$) of the magnetic field in the fluid path 114, and as in Equation 1, the force ($F_{cell}$) directly applied to the effective cell 20 in order to separate the effective cell 20 from the separation channel 122 is in proportion to the square of the gradient ($\nabla|B|$) of the magnetic field, the fine structure 121 increases force used to remove cell separation from the separation channel 122 to basically prevent the effective cell 20 from blocking the separation channel 122, thereby improving an entire self-extracting ability of the effective cell 20.

Meanwhile, in the present exemplary embodiment, the effective cell 20 is basically prevented from blocking the separation channel 122 by operating the magnetic field control portion 130 during the extraction process of the cell solution, such that the effective cell 20 is self-extracted, but in another modified embodiment, the effective cell 20 blocking the separation channel 122 may be extracted from the separation channel 122 by selectively generating the magnetic field by the magnetic field control portion 130 only in the case where the effective cell 20 blocks the separation channel 122.

Therefore, according to the present invention, it is possible to basically prevent the effective cell from blocking the separation channel and easily self-extract the effective cell by generating the magnetic field during the extraction operation or selectively generating the magnetic field.

The scope of the present invention is not limited to the aforementioned exemplary embodiments, but may be implemented by various exemplary embodiments within the range of the accompanying claims. Although the preferred embodiments of the present invention have been disclosed for illustrative purposes, those skilled in the art will appreciate that various modifications, additions and substitutions are possible, without departing from the scope and spirit of the invention as disclosed in the accompanying claims. Accordingly, such modifications, additions and substitutions should also be understood to fall within the scope of the present invention.

| <Description of symbols> | |
|---|---|
| 100: Apparatus for self-extracting a cell using a magnetic field according to an exemplary embodiment of the present invention | |
| 110: Flow path casing | 120: Separation portion |
| 130: Magnetic field control portion | |

What is claimed is:

1. An apparatus for self-extracting an effective cell that is a separation target from a cell solution using a magnetic field, comprising:

a flow path casing including an upper substrate, a side wall, and a lower substrate having a magnetic property combined with each other, wherein the side wall constitutes a border between the upper substrate and the lower substrate to form a fluid path in the flow path casing, and wherein the cell solution flows along the fluid path;

a separation portion disposed on the fluid path including a plurality of fine structures, wherein the plurality of fine structures is spaced apart from each other so that a width of each of the plurality of fine structures becomes gradually wide in a fluid direction of the cell solution which is perpendicular to the width of the plurality of fine structures to form a plurality of separation channels, and wherein the plurality of separation channels block the effective cell in the cell solution from passing therethrough; and a magnetic field control portion forming a magnetic field in the fluid path, wherein the effective cell blocking the separation channel is self-extracted by a force from the magnetic field.

2. The apparatus of claim 1, wherein:

the separation channel is constituted so that a width thereof becomes gradually narrow in the fluid direction of the cell solution.

3. The apparatus of claim 1, wherein:

an addition port for injecting the cell solution to the flow path casing and a discharge port for discharging a non-effective cell passing through the separation portion from the flow path casing are formed at both ends of the fluid path.

4. The apparatus of claim 1, wherein:

the lower substrate is formed by curing a mixed solution of a polymer resin and a ferromagnetic particle.

5. The apparatus of claim 1, wherein:

the magnetic field control portion includes an electromagnet to control an applied current, thereby controlling the intensity of the magnetic field.

* * * * *